US006192205B1

(12) United States Patent
Motohashi

(10) Patent No.: US 6,192,205 B1
(45) Date of Patent: Feb. 20, 2001

(54) IMAGE FORMING APPARATUS

(75) Inventor: Toshiaki Motohashi, Saitama (JP)

(73) Assignee: Ricoh Company, Ltd., Tokyo (JP)

( * ) Notice: Under 35 U.S.C. 154(b), the term of this patent shall be extended for 0 days.

(21) Appl. No.: 09/454,531

(22) Filed: Dec. 6, 1999

(30) Foreign Application Priority Data

Dec. 7, 1998 (JP) ..... 10-346359

(51) Int. Cl.[7] ..... G03G 15/16; G03G 15/01
(52) U.S. Cl. ..... 399/66; 399/302
(58) Field of Search ..... 399/66, 302, 308, 399/314

(56) References Cited

U.S. PATENT DOCUMENTS

| | | | | |
|---|---|---|---|---|
| 5,182,598 | * | 1/1993 | Hara et al. | 399/66 |
| 5,189,478 | * | 2/1993 | Hara et al. | 399/66 |
| 5,442,428 | | 8/1995 | Takahashi et al. . | |
| 5,640,645 | * | 6/1997 | Namekata et al. | 399/66 |

FOREIGN PATENT DOCUMENTS

| | | |
|---|---|---|
| 6-186860 | 7/1994 | (JP) . |
| 7-225520 | 8/1995 | (JP) . |

* cited by examiner

*Primary Examiner*—Arthur T. Grimley
*Assistant Examiner*—Hoang Ngo
(74) *Attorney, Agent, or Firm*—Oblon, Spivak, McClelland, Maier & Neustadt, P.C.

(57) ABSTRACT

An image forming apparatus of the present invention is of the type causing a toner image transferred by primary transfer to again move via a primary image transfer region before secondary transfer. The apparatus includes an image carrier for carrying the toner image to be transferred by the primary transfer. An intermediate image transfer body transfers the toner image transferred thereto by the primary transfer to a recording medium by secondary transfer. The intermediate image transfer body forms the primary image transfer region in contact with the image carrier. A charge depositing device applies a bias to the primary image transfer region to thereby form an electric field for the primary transfer. When the intermediate image transfer body again conveys the toner image via the primary image transfer region while running idle, an electric field forming device forms an electric field weaker than an electric field assigned to the primary transfer in the primary image transfer region. A controller variably controls, in accordance with the surface potential of the image carrier, a bias for forming the electric field during idle run. The apparatus reduces or fully obviates the reverse charging of toner during the idle run of the intermediate image transfer body and insures high quality images even with thick sheets or OHP (OverHead Projector) sheets.

18 Claims, 8 Drawing Sheets

*Fig. 4*

| POTENTIAL (V) | BIAS DURING IDLE RUN (V) | | | | | | |
|---|---|---|---|---|---|---|---|
| | 300 | 400 | 500 | 750 | 1000 | 1250 | 1500 |
| −450 | | ○ | ○ | ○ | ○ | × | × |
| −650 | ○ | ○ | △ | △ | × | × | × |
| −850 | ○ | △ | △ | △ | × | × | × |

*Fig. 7*

| TABLE NO | POTENTIAL | TABLE NO | POTENTIAL | TABLE NO | POTENTIAL | TABLE NO | POTENTIAL |
|---|---|---|---|---|---|---|---|
| 1 | −450 V | 6 | −550 V | 11 | −650 V | 16 | −750 V |
| 2 | −470 V | 7 | −570 V | 12 | −670 V | 17 | −770 V |
| 3 | −490 V | 8 | −590 V | 13 | −690 V | 18 | −790 V |
| 4 | −510 V | 9 | −610 V | 14 | −710 V | 19 | −810 V |
| 5 | −530 V | 10 | −630 V | 15 | −730 V | 20 | −830 V |

*Fig. 8*

| TABLE NO | CORRECTED VALUE | TABLE NO | CORRECTED VALUE | TABLE NO | CORRECTED VALUE | TABLE NO | CORRECTED VALUE |
|---|---|---|---|---|---|---|---|
| 1 | 0 V | 6 | 0 V | 11 | −20 V | 16 | −120 V |
| 2 | 0 V | 7 | 0 V | 12 | −40 V | 17 | −140 V |
| 3 | 0 V | 8 | 0 V | 13 | −60 V | 18 | −160 V |
| 4 | 0 V | 9 | 0 V | 14 | −80 V | 19 | −180 V |
| 5 | 0 V | 10 | 0 V | 15 | −100 V | 20 | −200 V |

IMAGE FORMING APPARATUS

BACKGROUND OF THE INVENTION

1. Field of the Invention

The present invention relates to a copier, facsimile apparatus, printer or similar image forming apparatus. More particularly, the present invention relates to an image forming apparatus of the type including an image carrier and an intermediate image transfer body facing each other to form a primary image transfer region, effecting primary transfer of a toner image from the image carrier to the intermediate image transfer body, and causing the intermediate image transfer body to again convey the image via the primary image transfer region before secondary transfer of the image to a recording medium.

2. Discussion of the Background

It has been customary with an image forming apparatus of the type described to vary the moving speed of the surface of an intermediate image transfer body at the time of secondary image transfer, depending on whether a recording medium to be used is a plain sheet or a thick or OHP (OverHead Projector) sheet. When use is made of, e.g., a thick sheet, the surface of the intermediate image transfer body is moved at a speed approximately one half of a speed assigned to a plain sheet. This is because an electric field formed in a secondary image transfer region where the intermediate image transfer body and a recording medium face each other becomes weaker when the medium is a thick sheet than when it is a plain sheet, resulting in short image transfer.

The above image forming apparatus includes a controller for controlling the moving speed of the surface of the intermediate image transfer body. Further, the controller accurately determines the position of a toner image completed on the intermediate image transfer body by the primary transfer by referencing the output of angular position sensing means. More specifically, a mark sensor playing the role of the angular position sensing means senses a mark provided on the intermediate image transfer body and sends its output to the controller. The controller by so determine the position of the image controls, e.g., the movement of a cleaning member into and out of contact with the intermediate image transfer body and the operation timing of a registration roller pair used to convey the recording medium to a secondary image transfer region.

As for the operation timing of the registration roller, for example, the controller calculates an interval between the time when it recognizes the position of the image and the time when the leading edge of the image arrives at the secondary image transfer region on the basis of the moving speed of the surface of the intermediate image transfer body. The controller drives the registration roller pair in accordance with the calculated interval. More specifically, the controller recognizes the position of the image on the basis of a period of time elapsed since the intermediate image transfer body has moved away from a sensing position where the mark sensor and the inner surface of the intermediate transfer body face each other.

The problem with the apparatus of the type executing sequence control on the basis of the above period of time is that when the moving speed of the surface of the intermediate image transfer body is switched, as stated above, a difference occurs between the position of the image recognized by the controller and the actual position of the image. Therefore, to effect secondary image transfer with a thick sheet or similar special sheet, the intermediate image transfer body carrying the image transferred thereto by the primary transfer must again bring its mark to the sensing position, so that the controller can again recognize the position of the image. This has customarily been done by causing the intermediate transfer body to run idle such that the image formed thereon is returned to the primary image transfer region via the secondary image transfer region before the secondary image transfer.

When the intermediate image transfer body again conveys its image to the primary image transfer region while running idle, charge depositing means included in the conventional apparatus for forming an electric field for the primary image transfer applies a bias of the same size as a bias for forming the above electric field. This undesirably increases a potential gap in the primary image transfer region, i.e., a difference between the bias to be deposited by the charge depositing means and the surface potential of the image carrier. When toner carried on the intermediate image transfer body enters the above region where the potential gap is great, and particularly when the body has a medium volume resistivity, it is likely that a charge is injected into the toner and charges it to a positive polarity. The toner so reversed in polarity is partly returned from the intermediate image transfer body to the image carrier in the primary image transfer region, resulting in a low density, vermicular image. This is particularly true with recycled toner whose amount of charge has been reduced.

Technologies relating to the present invention are disclosed in, e.g., Japanese Patent Laid-Open Publication Nos. 6-186860 and 7-225520.

SUMMARY OF THE INVENTION

It is therefore an object of the present invention to provide an image forming apparatus capable of reducing or fully obviating the reverse charging of toner during the idle run of an intermediate image transfer body and insuring high image quality even with a thick sheet or an OHP sheet.

An image forming apparatus of the present invention is of the type causing a toner image transferred by primary transfer to again move via a primary image transfer region before secondary transfer. The apparatus includes an image carrier for carrying the toner image to be transferred by the primary transfer. An intermediate image transfer body transfers the toner image transferred thereto by the primary transfer to a recording medium by secondary transfer. The intermediate image transfer body forms the primary image transfer region in contact with the image carrier. A charge depositing device applies a bias to the primary image transfer region to thereby form an electric field for the primary transfer. When the intermediate image transfer body again conveys the toner image via the primary image transfer region while running idle, an electric field forming device forms an electric field weaker than an electric field assigned to the primary transfer in the primary image transfer region. A controller variably controls, in accordance with the surface potential of the image carrier, a bias for forming the electric field during idle run.

BRIEF DESCRIPTION OF THE DRAWINGS

The above and other objects, features and advantages of the present invention will become more apparent from the following detailed description taken with the accompanying drawings in which:

FIG. 4 is a table listing a relation between the surface potential of a photoconductive element and the quality of an image determined by experiments;

FIG. 7 is a table listing the variation range of the surface potential of a photoconductive element divided by a preselected interval and unique to the alternative embodiment; and FIG. 8 is a table listing corrected values respectively corresponding to the surface potentials of FIG. 7.

DESCRIPTION OF THE PREFERRED EMBODIMENTS

Figure 1:
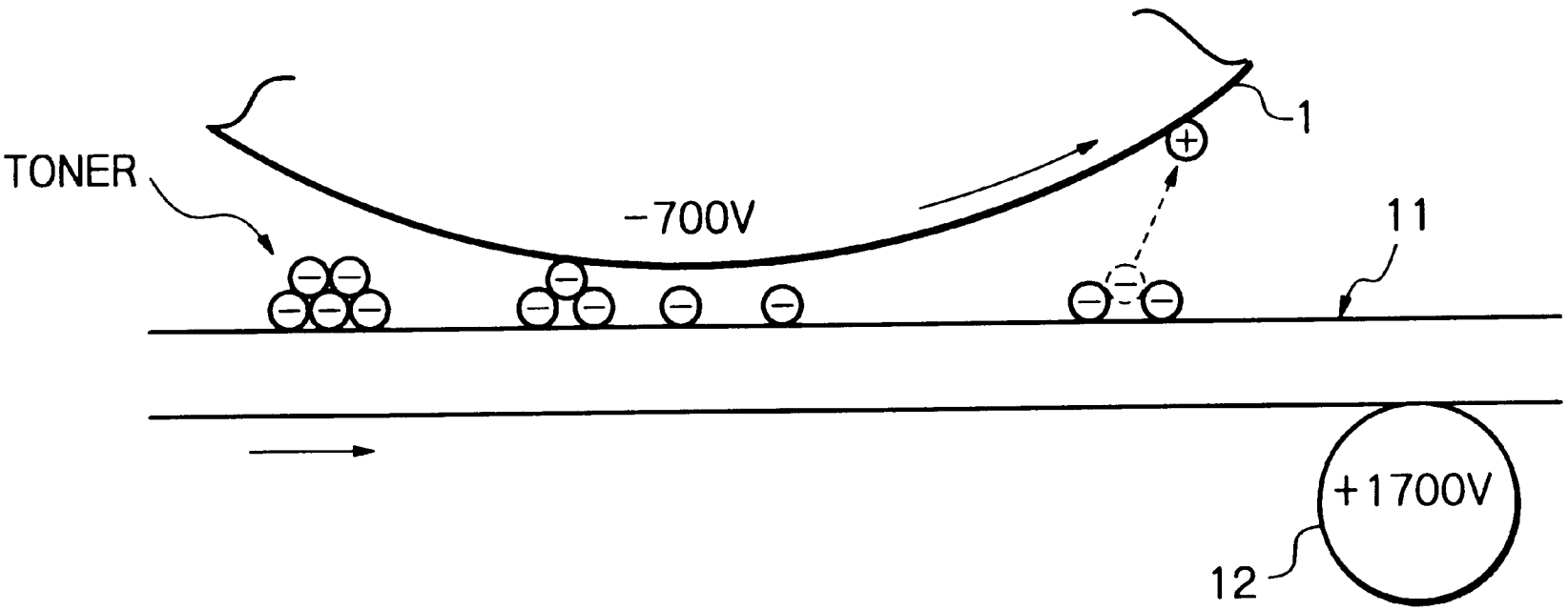
Fig. 1 PRIOR ART
FIG. 1 is a view showing a primary image transfer region included in a conventional image forming apparatus in a specific condition occurring during the idle run of an intermediate image transfer body.

To better understand the present invention, brief reference will be made to a conventional image forming apparatus of the type described. FIG. 1 shows a specific condition wherein an intermediate image transfer belt or intermediate image transfer body 11 included in the conventional apparatus runs idle through a primary image transfer region. There are shown in FIG. 1 a photoconductive drum 1 which is a specific form of an image carrier and a bias roller or charge depositing means 12 for primary image transfer in addition to the belt 11. Toner forming a toner image and charged to a negative polarity is carried on the belt 11.

During the idle run of the belt 11, the surface of the drum 1 has been uniformly charged to about −700 V. At the same time, a bias of about +1,700 V is applied to the bias roller 12. As a result, a potential gap at the primary image transfer region is as great as about 2,400 V. In addition, the belt 11 is formed of a material having a medium volume resistivity and not needing charging in order to simplify the mechanism. When the toner carried on the belt 11 enters the above region where the potential gap is great, and particularly when the belt 11 has a medium volume resistivity, it is likely that a charge is injected into the toner and charges it to a positive polarity. The toner so reversed in polarity is partly returned from the belt 11 to the drum 1 at the primary image transfer region, resulting in a low density, vermicular image. This is particularly true with recycled toner whose amount of charge has been reduced.

Figure 2:
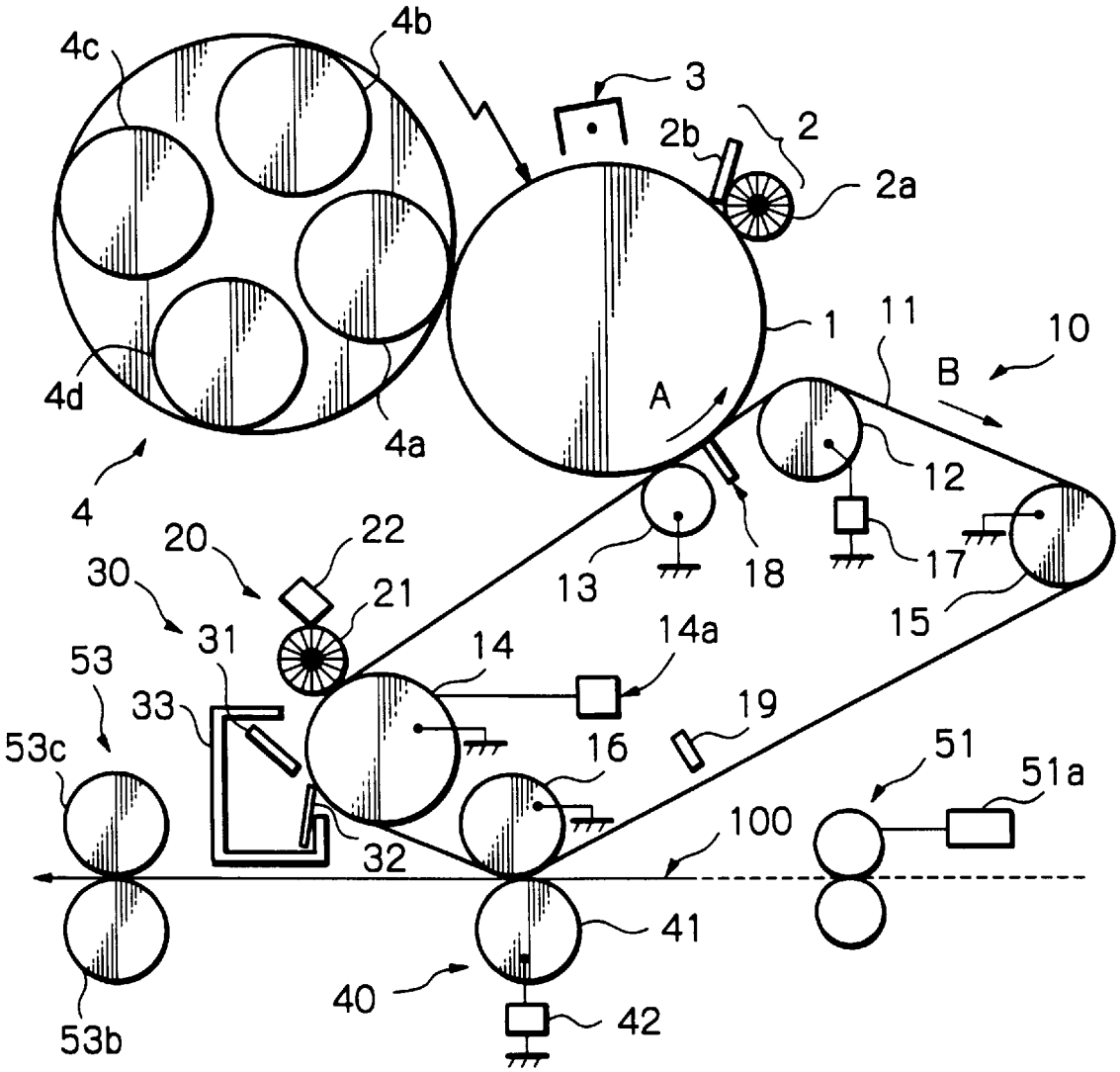
FIG. 2 is a view showing an image forming apparatus embodying the present invention.

Referring to FIG. 2, an image forming apparatus embodying the present invention is shown and implemented as a full-color electrophotographic copier by way of example. The copier is generally made up of a scanner section or color image reading device, not shown, and a printer section or color image recording device.

The construction and operation of the scanner section will be briefly described first. The scanner section includes a glass platen on which a document is laid. While scanning optics including a lamp, mirrors and a lens optically scans the document, the resulting reflection from the document is incident to a color sensor. The color sensor reads color image information color by color, e.g., on a B (blue), G (green) and R (red) basis while transforming them to corresponding color-by-color electric image signals. The color image sensor is implemented by, e.g., a CCD (Charge Coupled Device) image sensor capable of reading the three colors at a time. An image processing section converts the B, G and R image signals output from the scanner section to Bk (black), C (cyan), M (Magenta) and Y (Yellow) color image data. More specifically, the scanning optics scans the document in response to a start signal synchronous to the operation of the printer section, causing the above color image data to be output. The image processing section outputs image data of one color every time the scanning optics scans the document, the optics repeats its scanning operation four consecutive times in order to output Bk, C, M and Y color image data.

As shown in FIG. 2, the printer section includes an optical writing unit or exposing means, not shown, and a photoconductive drum or image carrier 1. The optical writing unit transforms the color image data received from the scanner section to an optical signal color by color and forms a negative latent image corresponding to the document image on the drum 1 uniformly charged to negative polarity beforehand. The writing unit may include a semiconductor laser, a control section for controllably driving the laser, a polygonal mirror, a motor for driving the polygonal mirror, an f/θ lens, and a mirror. The drum 1 is caused to rotate counterclockwise, as indicated by an arrow A in FIG. 2.

Arranged around the drum 1 are a drum cleaning device or cleaning means 2, a charger or charging means 3, a developing unit or developing means 4, and an intermediate image transfer unit or intermediate image transferring means 10. In the illustrative embodiment, the developing unit 4 is implemented as a revolver type developing unit and will be simply referred to as a revolver hereinafter. The drum cleaning device 2 includes a fur brush 2*a* and a cleaning blade 2*b* and cleans the surface of the drum 1 after primary image transfer.

The revolver 4 has a Bk developing section 4*a*, a C developing section 4*b*, an M developing section 4*c*, and a Y developing section 4*d* and is revolvable to locate any one of the developing sections 4*a*–4*d* at a preselected developing section where it faces the drum 1. The developing sections 4*a*–4*d* are identical in configuration, and each includes a paddle or agitating means for agitating a developer, a toner content sensor or toner content sensing means, and a sleeve or developer carrier for causing the developer deposited thereon to contact the surface of the drum 1, although not shown specifically.

In the illustrative embodiment, developers of different colors stored in the developing sections 4*a*–4*d* each are a two ingredient type developer, i.e., a toner and carrier mixture; the toner is charged to a negative polarity. When the toner content of the developer stored in any one of the developing sections 4*a*–4*d* decreases due to repeated development, the toner content sensor assigned to the developing section senses the decrease of toner content. In response to the resulting output of the toner content sensor, toner of the same color as the above toner is replenished to the developing section from one of toner bottles, not shown, mounted on a toner replenishing device. As a result, the toner content of the developer is maintained constant.

In the intermediate image transfer unit 10, an intermediate image transfer belt or intermediate image transfer body 11 is passed over a primary transfer bias roller or charge depositing means 12, a ground roller or primary transfer predischarging means, a drive roller or belt driving means 14, a tension roller 15, and a counter roller 16 which is used to effect secondary image transfer which will be described later. A primary transfer power supply 17 applies a bias for primary image transfer to the bias roller 12. A belt drive motor 14*a* drives the belt 14 under the control of a controller or control means 60 (see FIG. 3). All the rollers 12–16 over which the belt 11 is passed are formed of a conductive material, and the rollers 13–16 are connected to ground.

The bias roller 12 is positioned downstream of, but close to, a primary image transfer region or nip where the belt 11 and drum 1 contact each other in the direction in which the surface of the belt 11 moves (direction of belt movement hereinafter), i.e., in a direction indicated by an arrow B in FIG. 2. The ground roller 13 connected to ground is located upstream of, but close to, the primary image transfer region in the direction of belt movement B. The bias roller 12 and ground roller 13 press the belt 11 against the drum 1, so that the above nip is formed between the roller 13 and the drum 1.

The belt 11 has a laminate structure made up of a surface layer, an intermediate layer, and a base layer. The belt 11 is positioned such that the surface layer faces the drum 1 while the base layer is remotest from the drum 1. An adhesive layer intervenes between the intermediate layer and the base layer for adhering them to each other. The belt 11 has a medium volume resistivity ρv of about $10^{11}$ Ωcm, as measured by a method prescribed by JIS (Japanese Industrial Standards) K6911. While the belt 11 may have a volume resistivity ρv of $10^{12}$ Ωcm or above in order to effectively obviate toner scattering after the primary image transfer, the belt 11 with such a volume resistivity must be discharged after the secondary transfer. Volume resistivities ρv of $10^{14}$ Ωcm or above would lower the durability of the belt 11. The belt 11 is so configured as to have a surface resistance of about $10^{13}$ $\Omega/cm^2$ on its surface layer.

Reinforcing members, not shown, are fitted on opposite widthwise edges of the inner surface of the belt 11. While the reinforcing members serve to prevent the belt 11 from twisting or otherwise deforming, they are apt to form gaps between the above edges of the belt 11 and the drum 1 at the time of primary image transfer. In light of this, backup members 18 abut against the opposite edges of the belt 11 in order to fill up the gaps.

The intermediate image transfer unit 10 additionally includes a mark sensor 19 adjoining the inner surface of the belt 11. The mark sensor or angular position sensing means 19 is connected to the controller 60, FIG. 3, and responsive to a mark provided on the inner surface of the belt 11. In response to the output of the mark sensor 19, the controller 60 determines the position of an image formed on the belt 11.

A lubricant applying device or lubricant applying means 20, a belt cleaning device or belt cleaning means 30 and an image transfer unit or image transferring means 40 are arranged around the belt 11. Moving mechanisms each selectively move an associated one of the lubricant applying device 20, belt cleaning device 30 and image transfer unit into or out of contact with the belt 11.

The lubricant applying device 20 is made up of a brush roller or lubricant applying member 21 and a case 22 accommodating a solid lubricant and springs not shown specifically. The solid lubricant may be implemented by fine zinc stearate particles molded in a plate-like configuration. The springs constantly press the solid lubricant against the brush roller 21. Drive means, not shown, causes the brush roller 21 to rotate. After the secondary image transfer, the brush roller 21 is rotated to shave off the solid lubricant and to apply the resulting powder to the belt 11. At this instant, the brush roller 21 moves in the same direction as the belt 11 at a position where the roller 21 contacts the belt 11, so that the bristles of the roller 21 are prevented from collapsing. In addition, the brush roller 21 is so control led as to move at a higher linear velocity than the belt 11 at a lubricant applying position where the roller 21 and belt 11 contact each other.

The belt cleaning device 30 is made up of a cleaning blade or cleaning member 31, an inlet seal or sealing means 32, and a casing 33. Toner removed from the belt 11 by the cleaning blade 31 is collected in the casing 33. The inlet seal 32 receives the above toner and guides it into the casing 33. This successfully prevents the toner from flying about in the apparatus.

The image transfer unit 40 includes a secondary transfer bias roller 41 facing the previously mentioned counter roller 16 of the intermediate image transfer unit 10. A secondary transfer power supply 42 is connected to the bias roller 41. At the time when an image formed on the belt 11 is to be transferred to a sheet or recording medium 100 at a secondary image transfer region between the transfer roller 41 and the counter roller 16, the power supply 42 applies a bias for secondary image transfer to the bias roller 41.

The printer section additionally includes a registration roller pair 51 adjoining the upstream side of the secondary image transfer region in the direction in which the sheet 100 is fed. The sheet 100 is paid out from a cassette or a manual feed tray assigned to special sheets including OHP sheets and thick sheets. A drive motor 51*a* causes the registration roller pair 51 to convey the sheet 100 toward the secondary image transfer region at a preselected timing.

The printer section further includes a sheet conveyor unit, not shown, a fixing unit or fixing means 53, and a copy tray not shown. The fixing unit 53 includes a heat roller 53*a* and a press roller 53*b* for fixing a toner image transferred from the belt 11 to the sheet 100 with heat and pressure.

The controller 60 controls the moving mechanisms assigned to, e.g., the brush roller 21 and cleaning blade 31, the intensity of the bias to be applied by the primary transfer power supply 17, and the rotation speed of the belt drive motor 14a as well as other various factors.

A specific operation of the illustrative embodiment will be described hereinafter on the assumption that a Bk, a C, an M and a Y latent image are sequentially developed in this order.

On the start of a copying operation, the scanner section reads color image data out of a document. In the printer section, the writing unit scans the drum 1 with a laser beam in accordance with Bk image data derived from the above color image data, thereby forming a Bk latent image on the drum 1. The Bk developing section 4*a* of the revolver 4 develops the Bk latent image with Bk toner to thereby form a Bk toner image. To insure the development of the Bk latent image, the sleeve of the Bk developing section 4*a* is brought to the developing position before the leading edge of the Bk latent image arrives at the developing position. That is, the ear of the Bk developer deposited on the sleeve is brought to an operative position before the arrival of the leading edge of the Bk latent image at the developing position, so that the entire Bk latent image is surely developed. As soon as the trailing edge of the Bk latent image moves away from the developing position, the developer deposited on the sleeve of the Bk developing section 4*a* is rendered inoperative. This is completed at least before the leading edge of a C latent image to be developed next arrives at the developing position. To render the above developer of the sleeve inoperative, the sleeve may be rotated in the direction opposite to the direction assigned to development.

The Bk toner image formed on the drum 1 by the above procedure is transferred to the surface of the belt 11 moving at the same speed as the drum 11 (primary image transfer).

In parallel with the primary transfer of the Bk toner image, the scanner section again reads the color image data out of the document at a preselected timing. The writing unit scans the drum 1 with a laser beam in accordance with C image data derived from the color image data so as to form a C toner image. The C developing section 4*b* of the revolver 4 develops the C latent image to thereby form a C toner image. The sleeve of the C developing section 4C is caused to start rotating after the trailing edge of the Bk latent image has moved away from the developing position, but before the leading edge of the C latent image arrives at the developing position. After the trailing edge of the C latent image has moved away from the developing position, the developer deposited on the above sleeve is brought to an inoperative position. This is also completed before the leading edge of an M latent image to be developed next arrives at the developing position. The C toner image is transferred from the drum 1 to the belt 11 over and in accurate register with the Bk toner image existing on the belt 11.

The same procedure is repeated with an M latent image and a Y latent image. As a result, an M and a Y toner image are sequentially transferred from the drum 1 to the belt 11 over the composite Bk and C toner image existing on the belt 11. Consequently, a composite Bk, C, M or Y toner image or full-color toner image is completed on the belt 11.

The moving mechanisms stated earlier maintain the cleaning blade 31 and inlet seal 32 of the belt cleaning device 30 and the secondary transfer bias roller 41 of the image transfer unit 40 spaced from the belt 11 until the full-color toner image has been completed on the belt 11, i.e., during the interval between the primary transfer of the Bk toner image and the primary transfer of the Y toner image.

The belt 11 conveys the full-color toner image to the secondary image transfer region to which the sheet 100 is fed. Usually, the moving mechanism assigned to the secondary transfer bias roller 41 moves the roller 41 into contact with the belt 11 at the time when the toner image is transferred from the belt 11 to the sheet 100 (secondary image transfer). Subsequently, the secondary transfer power supply 42 applies a preselected bias to the bias roller 41 with the result that an electric field for secondary image transfer is formed in the secondary image transfer region. Consequently, the toner image is transferred from the belt 11 to the sheet 100. It is to be noted that the sheet 100 is fed from a cassette selected on an operation panel, not shown, to the secondary image transfer region via the registration roller pair 51. More specifically, the registration roller pair 51 drives the sheet 100 at such a timing that the leading edge of the sheet 100 meets the leading edge of the toner image carried on the belt 11 at the secondary image transfer region.

The sheet 100 carrying the full-color toner image thereon is conveyed to the fixing unit 53 by the sheet conveyor unit mentioned earlier. After the toner image has been fixed on the sheet 100 by the fixing unit 53, the sheet or copy 100 is driven out of the copier to the copy tray.

After the primary transfer, the drum cleaning unit 2 cleans the surface of the drum 1. Subsequently, a discharge lamp or discharging means, not shown, discharges the surface of the drum 1. After the secondary transfer, the moving means assigned to the belt cleaning device 30 moves the cleaning blade 31 and inlet seal 32 into contact with the belt 11 in order to clean the surface of the belt 11. In the illustrative embodiment, the cleaning blade 31 and inlet seal 32 are moved by a single moving mechanism by way of example.

In a repeat copy mode, the scanner section reads the first color or Bk image information for the second copy at a preselected timing after reading the fourth color or Y image information for the first copy. The printer section forms a Bk latent image on the drum 1 in accordance with the Bk image information and then develops it to produce a Bk toner image. This Bk toner image is transferred from the drum 1 to the area of the belt 11 having been cleaned by the belt cleaning device 30 after the secondary transfer of the first full-color toner image.

In a three-color or a two-color copy mode, the illustrative embodiment operates in the same manner as in the above full-color copy mode except for the colors used. Further, in a one-color copy mode, only the developer of the developing section corresponding to a desired color is maintained operative while the belt 1 is continuously driven in the forward direction. At this instant, the brush roller 21, cleaning blade 31, inlet seal 32 and secondary transfer bias roller 41 are held in contact with the belt 11, and the belt 11 is held in contact with the drum 1.

Figure 3:
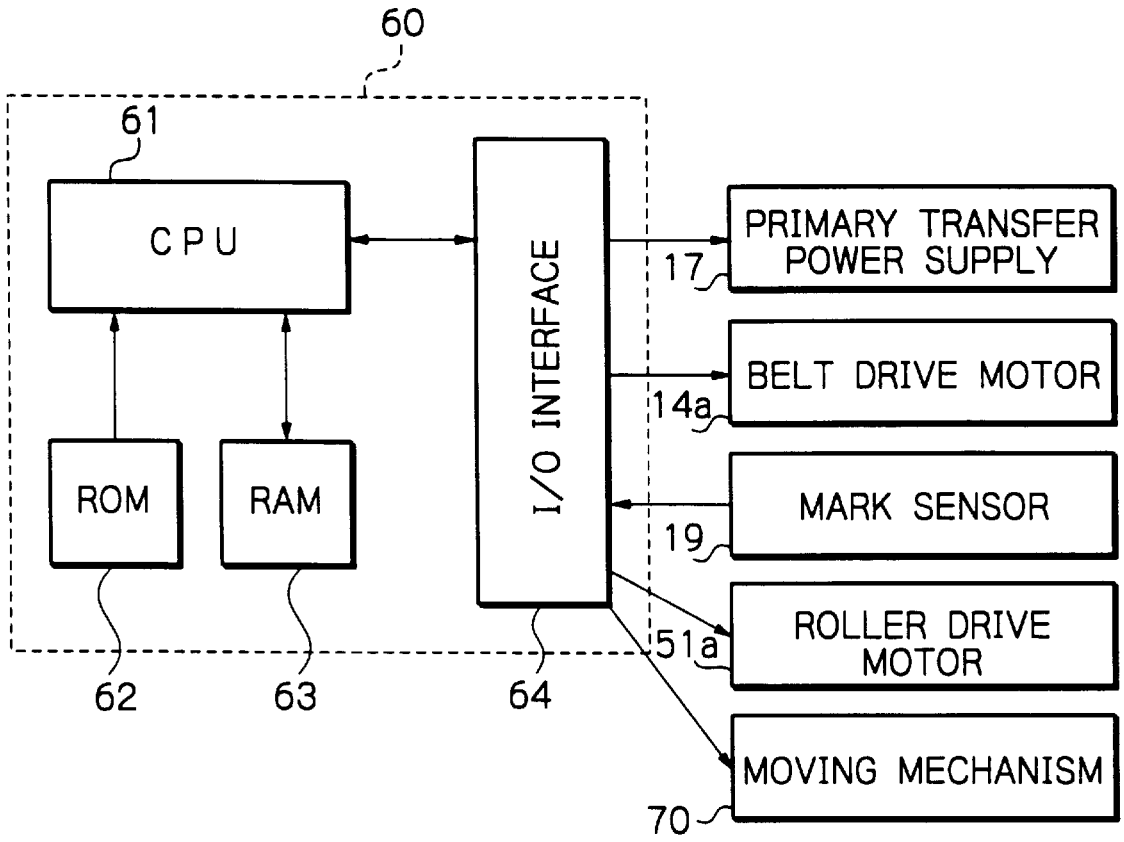
FIG. 3 is a block diagram schematically showing a controller included in the illustrative embodiment.

FIG. 3 shows the controller 60 included in the illustrative embodiment. As shown, the controller 60 includes a CPU (Central Processing Unit) 61, a ROM (Read Only Memory) 62, a RAM (Random Access Memory) 63, and an I/O (Input/Output) interface 64. The primary transfer power supply 17, belt drive motor 14*a*, mark sensor 19, roller drive motor 51*a* and moving mechanism, labeled 70, for moving the brush roller 21, cleaning blade 31 and inlet seal 32 are connected to the I/O interface 64.

In the illustrative embodiment, the controller 60 accurately determines the position of an image formed on the belt 11 on the basis of the output of the mark sensor 19. On determining the position of the image, the controller 60 controls the operation of the moving mechanism 70 and the operation of the registration roller pair 51 in accordance with the position of the image. Specifically, to control the operation timing of the registration roller pair 51, the controller 60 calculates a period of time necessary for the leading edge of the image on the belt 11 to arrive at the secondary image transfer region on the basis of the running speed of the belt 11.

At the time of secondary image transfer, the controller 60 causes the belt 11 to rotate at a particular speed in each of a plain sheet mode in which the sheet 100 is a plain sheet and a thick sheet mode in which the sheet 100 is a thick sheet or an OHP sheet. Specifically, the controller 60 controls the belt drive motor 14*a* such that in the thick sheet mode the belt 11 runs at a speed one half of a speed assigned to the plain sheet mode.

In the plain sheet mode, the belt 11 runs at the same speed for both of primary image transfer and secondary image transfer. However, in the thick sheet mode, it is necessary to reduce the running speed of the belt 11 to one half of the speed assigned to the plain sheet mode. More specifically, the running speed of the belt 11 must be halved after the primary transfer of the toner image of the last color from the drum 1 to the belt 11, but before the secondary transfer of the resulting full-color image from the belt 11 to the sheet 100. At this instant, it is almost impracticable to accurately set such a variation of the running speed of the belt 11. It is therefore extremely difficult for the controller 60 to accurately determine the position of the image carried on the belt 11 after the variation of the above speed. As a result, a difference occurs between the position determined by the controller 60 and the actual position. Therefore, after the speed of the belt 11 has been halved and then stabilized, the mark provided on the belt 11 must be again brought to the mark sensing position, so that the controller 60 can again recognize the position of the image.

Assume that a so-called P pattern for toner content control is formed on the belt 11 at the tailing edge of the image or at the rear of the same. Then, the leading edge of the image usually arrives at the secondary image transfer region before the trailing edge of the P pattern moves away from the primary image transfer region. Alternatively, the leading edge of the image on the belt 11 arrives at the secondary image transfer region before the belt 11 is decelerated and then stabilized. In light of this, it has been customary to cause, after the primary image transfer, the belt 11 to run idle for conveying the image via the secondary image transfer region once, thereby allowing the controller 60 to again recognize the position of the image. This is followed by the secondary image transfer. Such an idle run is not necessary if the belt 11 can be decelerated and stabilized before the leading edge of the image arrives at the secondary image transfer region. However, this is not practicable without changing the construction, e.g., increasing the length of the belt 11 and moreover increasing the overall size of the image transfer unit 10.

During the above idle run of the belt 11, the image on the belt 11 again moves via the primary image transfer region. At this instant, the illustrative embodiment causes the primary transfer power supply 17 to apply a bias lower than the bias assigned to the primary image transfer to the bias roller 12. This bias, in principle, should preferably be zero because it can reduce the reverse charging of the toner more as its value decreases. In practice, however, when the bias application from the power supply 17 to the bias roller 12 is fully interrupted, a certain period of time is necessary for it to start again, delaying the start of the next image forming procedure. In light of this, in the illustrative embodiment, the bias to be applied during idle run is selected to be about 300 V that is the minimum value not needing the above period of time. It is to be noted such a bias may be suitably selected in matching relation to, e.g., the performance of the power supply 17.

Hereinafter will be described a relation between the surface potential of the drum 1 and bias assigned to the idle run and the quality of an image. The surface potential of the drum 1 depends on the environment and varies, in the illustrative embodiment, by about ±200 V at both sides of −650 V, i.e., over the range of from −450 V to −850 V although the range depends on the kind of the drum 1, among others. FIG. 4 shows the results of evaluating of images produced by varying the above bias with respect to the surface potentials of the drum 1 of −450 V, −650 V and −850 V. Specifically, biases of 300 V to 1,500 V were applied at each of the surface potentials of −450 V, −650 V and −850 V. In FIG. 4, circles are representative of high quality images free from spots while crosses are representative of low quality images including noticeable spots. Triangles are representative of images including some spots, but lying in an acceptable range.

The reverse charging of the toner forming an image on the belt 11 depends on the potential gap, i.e., the difference between the surface potential of the drum 1 and the bias applied during idle run, as stated earlier. The reverse charging of the toner is noticeable when the potential gap is greatest. As FIG. 4 indicates, the potential gap is greatest when the surface potential of the drum 1 is −850 V. It follows that when the surface potential is −850 V, the reverse charging of the toner can be substantially fully obviated if the above bias is so selected as to set up a potential gap capable of stably obviating the reverse charging.

Figure 5:
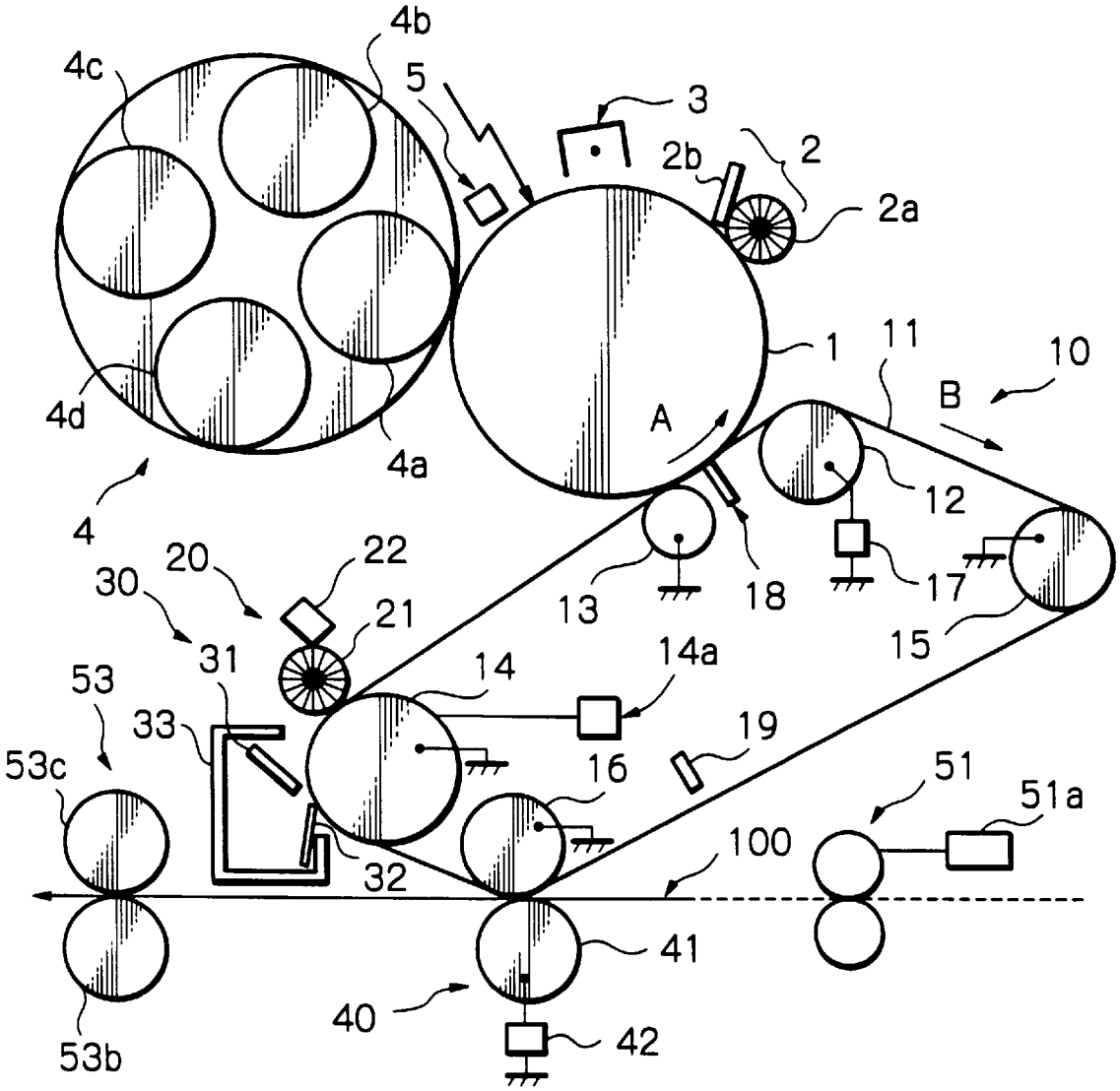
FIG. 5 is a view showing an alternative embodiment of the present invention.

Reference will be made to FIG. 5 for describing an alternative embodiment of the present invention that is also implemented as a full-color electrophotographic copier. The copier also includes a scanner section, not shown, identical with the scanner section of the previous embodiment and differs from the previous embodiment only in the configuration of the printer section and a control system. In FIG. 5, structural elements identical with the structural elements shown in FIG. 2 are designated by identical reference numerals and will not be described specifically in order to avoid redundancy.

As shown in FIG. 5, a surface potential sensor or surface potential sensing means 5 adjoins the surface of the drum 1 for sensing the surface potential of the drum 1. The surface potential sensor 5 is connected to a controller or control means 160 (see FIG. 6) constructed to execute the same control as the controller 60, FIG. 3, except for the following. In the illustrative embodiment, the controller 160 controls the bias to be applied from the primary transfer power supply 17 to the bias roller 12 in accordance with the surface potential of the drum 1 sensed by the surface potential sensor 5.

Figure 6:
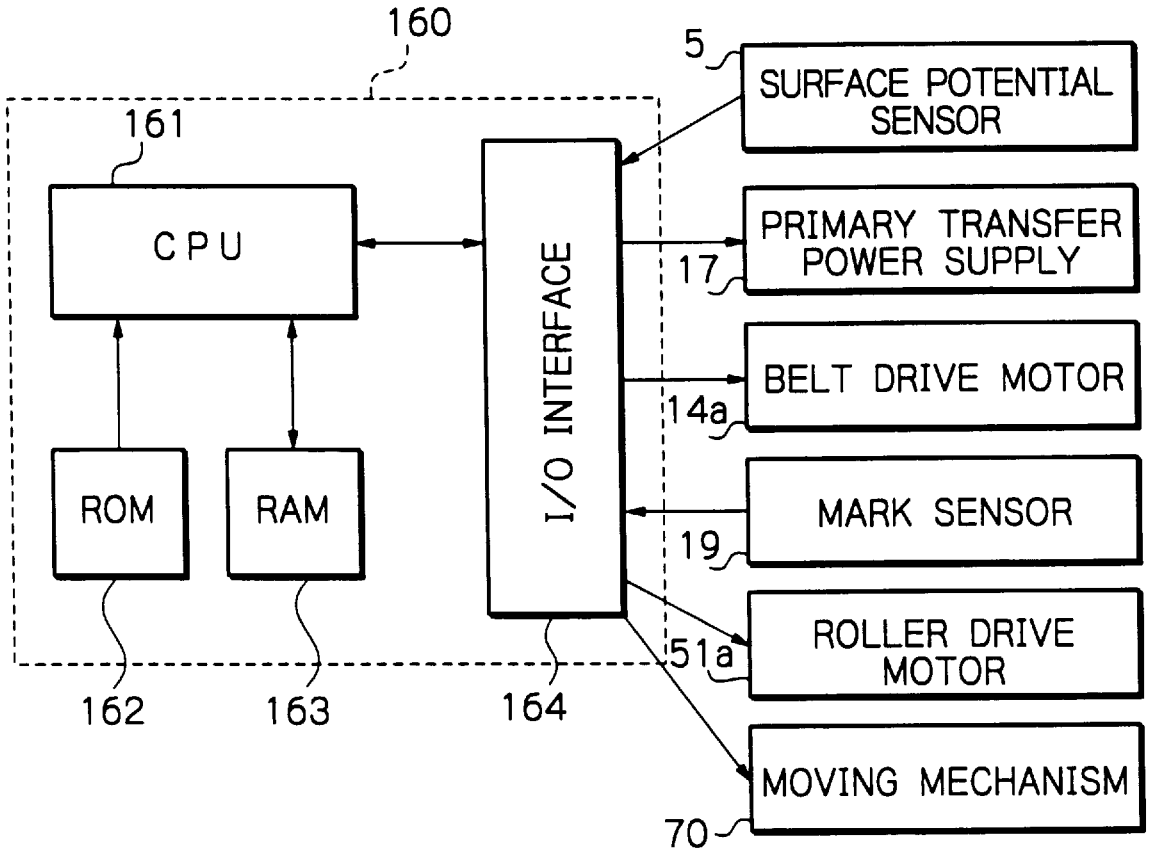
FIG. 6 is a block diagram schematically showing a controller included in the alternative embodiment.

As shown in FIG. 6, the controller 160 has a CPU 161, a ROM 162, a RAM 163, and an I/O interface 164. The primary transfer power supply 17, belt drive motor 14*a*, mark sensor 19, roller drive motor 51*a*, moving mechanism 70 for moving the brush roller 21, cleaning blade 31 and inlet seal 32 and surface potential sensor 5 are connected to the I/O interface 64.

The probability of reverse charging of the toner decreases with a decrease in the bias to be applied during idle run, as stated in relation to the previous embodiment. However, should the bias be excessively low, electrostatic attraction acting between the drum 1 and the belt 11 at the primary image transfer region would decrease and would thereby obstruct the close contact of the drum 1 and belt 11, resulting in positional deviation between the drum 1 and the belt 11.

The close contact of the drum 1 and belt 11 depends on the surface potential of the drum 1 as well as on the previously stated potential gap. However, the surface potential of the drum 1 depends on the environment, as stated earlier. Therefore, the fixed low bias applied during idle run in the previous embodiment cannot obviate the positional deviation between the drum 1 and the belt 11 although it can obviate the reverse charging of the toner.

In the illustrative embodiment, the controller 160 determines the surface potential of the drum 1 at the time of the idle run of the belt 11 and variably controls the bias in accordance with the determined surface potential. Specifically, the range over which the surface potential of the drum 1 varies in accordance with the environment is divided by a preselected interval in the form of tables, and a particular bias is listed in each table. FIG. 7 shows specific tables each listing a particular surface potential.

In the illustrative embodiment, every time a toner image is transferred from the drum 1 to the belt 11 over a toner image existing on the belt 11 by the primary image transfer, the bias for the transfer is increased stepwise. Specifically, while a bias of 1,700 V is selected for a toner image of the first color, it is raised to 1,800 V for a toner image of the second color, to 1,900 V for a toner image of the third color, and to 2,000 V for a toner image of the fourth color. These biases are, of course, suitably selected in matching relation to, e.g. the structure of an image forming apparatus to be used. Further, the illustrative embodiment corrects the bias for primary image transfer in accordance with the surface potential shown in FIG. 7, thereby maintaining the electrified for primary transfer constant. FIG. 8 lists the biases corrected in accordance with the surface potential of the drum 1.

While the illustrative embodiments each include an image carrier implemented by a photoconductive drum, the present invention is practicable even with, e.g., an endless photoconductive belt passed over two rollers. One or both of the bias rollers playing the role of charge depositing means for primary and secondary image transfer may be replaced with blades, brushes or any other suitable members. This is also true with the ground roller serving as primary or secondary image transfer predischarging means.

As for the intermediate transfer belt, use may be made of any other suitable intermediate image transfer body, e.g., a drum or a roller. Of course, the surface resistance and other electrical characteristics of the belt described are only illustrative and may be suitably selected in accordance with image forming conditions, among others.

The illustrative embodiments have concentrated on a reversal development system charging the image carrier to negative polarity and using a two-ingredient type developer. The present invention is, of course, similarly practicable with an image carrier chargeable to positive polarity and a one-ingredient type developer or a regular development system.

In summary, an image forming apparatus of the present invention achieves various unprecedented advantages, as enumerated below.

(1) When an intermediate image transfer body performs an idle run for again conveying a toner image completed thereon via a primary image transfer region, an electric field weaker than an electricfield for the primary image transfer is set up. This successfully reduces a potential gap at the primary image transfer region during idle run and therefore allows a minimum of reverse charging of toner to occur when the image moves via the above region.

(2) The bias during idle run is varied in accordance with the surface potential of an image carrier, so that the potential gap at the primary image transfer region can be maintained substantially constant during idle run. This not only effectively obviates the reverse charging of toner, but also sets up an adequate potential gap protecting the intermediate image transfer body and image carrier from positional deviation.

(3) The bias during idle run is selected to be 30% of a bias for forming the electric field for the primary image transfer, so that the reverse charging of the toner can be stably obviated.

(4) High quality images can be formed even on thick sheets and OHP sheets.

Various modifications will become possible for those skilled in the art after receiving the teachings of the present disclosure without departing from the scope thereof.

What is claimed is:

1. An image forming apparatus of a type causing a toner image transferred by a primary image transfer to again move via a primary image transfer region before a secondary image transfer, said image forming apparatus comprising:

an image carrier for carrying the toner image to be transferred by the primary image transfer;

an intermediate image transfer body for transferring the toner image transferred thereto by the primary image transfer to a recording medium by the secondary image transfer, said intermediate image transfer body forming the primary image transfer region in contact with said image carrier;

charge depositing means for applying a bias to said primary image transfer region to thereby form an electric field for the primary image transfer;

electric field forming means for forming, when said intermediate image transfer body again conveys the toner image via the primary image transfer region while running idle, an electric field weaker than an electric field assigned to the primary image transfer in said primary image transfer region;

sensing means for sensing a surface potential of said image carrier; and control means for variably controlling, in accordance with the sensed surface potential of said image carrier, the bias for forming the electric field during the idle run of said intermediate image transfer body.

2. An apparatus as claimed in claim 1, wherein said intermediate image transfer body has a volume resistivity between $10^8$ Ωcm and $10^{11}$ Ωcm.

3. An apparatus as claimed in claim 2, wherein the bias for forming the electric field during the idle run is lower than the bias for forming the electric field for the primary image transfer.

4. An apparatus as claimed in claim 2, wherein said control means controls the bias to be applied by said charge depositing means such that the electric field weaker than the electric field for the primary image transfer is formed in said primary image transfer region.

5. An apparatus as claimed in claim 1, wherein the bias for forming the electric field during the idle run is lower than the bias for forming the electric field for the primary image transfer.

6. An apparatus as claimed in claim 1, wherein said control means controls the bias to be applied by said charge depositing means such that the electric field weaker than the electric field for the primary image transfer is formed in said primary image transfer region.

7. An image forming apparatus of a type causing a toner image transferred by a primary image transfer to again move via a primary image transfer region before a secondary image transfer, said image forming apparatus comprising:

means for carrying the toner image to be transferred by the primary image transfer;

means for transferring the toner image transferred thereto by the primary image transfer to a recording means by the secondary image transfer;

means for forming a first electric field for the primary image transfer;

means for forming, when said transferring means again conveys the toner image via the primary image transfer region while running idle, a second electric field weaker than the first electric field in said primary image transfer region; and sensing means for sensing a surface potential of said image carrier;

control means for variably controlling, in accordance with the sensed surface potential of said image carrier, the second electric field during the idle run of said intermediate image transfer body.

8. An apparatus as claimed in claim 7, wherein the second electric field during the idle run is lower than the first electric field for the primary image transfer.

9. An apparatus as claimed in claim 7, wherein said control means controls the second electric field weaker than the first electric field for the primary image transfer is formed in said primary image transfer region.

10. An image forming apparatus of a type causing a toner image transferred by a primary image transfer to again move via a primary image transfer region before a secondary image transfer, said image forming apparatus comprising:

an image carrier configured to carry the toner image to be transferred by the primary image transfer;

an intermediate image transfer body configured to transfer the toner image transferred thereto by the primary image transfer to a recording medium by the secondary image transfer, said intermediate image transfer body forming the primary image transfer region in contact with said image carrier;

a bias roller configured to apply a bias to said primary image transfer region to thereby form an electric field for the primary image transfer;

an electric field generator configured to generate when said intermediate image transfer body again conveys the toner image via the primary image transfer region while running idle, an electric field weaker than an electric field assigned to the primary image transfer in said primary image transfer region; and a surface potential sensor configured to sense a surface potential of said image carrier;

a controller configured to variably control, in accordance with the sensed surface potential of said image carrier, the bias for forming the electric field during the idle run of said intermediate image transfer body.

11. An apparatus as claimed in claim 10, wherein said intermediate image transfer body has a volume resistivity between $10^8$ Ωcm and $10^{11}$ Ωcm.

12. An apparatus as claimed in claim 11, wherein the bias for forming the electric field during the idle run is lower than the bias for forming the electric field for the primary image transfer.

13. An apparatus as claimed in claim 11, wherein said controller controls the bias to be applied by said charge depositing means such that the electric field weaker than the electric field for the primary image transfer is formed in said primary image transfer region.

14. An apparatus as claimed in claim 10, wherein the bias for forming the electric field during the idle run is lower than the bias for forming the electric field for the primary image transfer.

15. An apparatus as claimed in claim 10, wherein said controller controls the bias to be applied by said charge depositing means such that the electric field weaker than the electric field for the primary image transfer is formed in said primary image transfer region.

16. An image forming method for a toner image transferred by a primary image transfer to again move via a primary image transfer region before a secondary image transfer, in an image forming apparatus including an image carrier for carrying the toner image to be transferred by the primary image transfer and an intermediate image transfer body for transferring the toner image transferred thereto by the primary image transfer to a recording medium by the secondary image transfer, said intermediate image transfer body forming the primary image transfer region in contact with said image carrier, said image forming method comprising the steps of:

applying a bias to said primary image transfer region to thereby form an electric field for the primary image transfer;

forming, when said intermediate image transfer body again conveys the toner image via the primary image transfer region while running idle, an electric field weaker than an electric field assigned to the primary image transfer in said primary image transfer region;

sensing a surface potential of said image carrier; and variably controlling, in accordance with the sensed surface potential of said image carrier, the bias for forming the electric field during the idle run of said intermediate image transfer body.

17. A method apparatus as claimed in claim 16, wherein the bias for forming the electric field during the idle run is lower than the bias for forming the electric field for the primary image transfer.

18. A method as claimed in claim 16, wherein said variable control step the bias is applied such that the electric field weaker than the electric field for the primary image transfer is formed in said primary image transfer region.

* * * * *

UNITED STATES PATENT AND TRADEMARK OFFICE

CERTIFICATE OF CORRECTION

PATENT NO. : 6,192,205 B1
DATED : February 20, 2001
INVENTOR(S) : Motohashi

It is certified that error appears in the above-identified patent and that said Letters Patent is hereby corrected as shown below:

On the title page, Item (54), and at the top of Column 1, the title should be:

(54) IMAGE FORMING APPARATUS WHICH CONTROLS A BIAS DURING AN IDLE RUN OF AN INTERMEDIATE TRANSFER BODY

Signed and Sealed this

Twelfth Day of June, 2001

*Attest:*

Nicholas P. Godici

*Attesting Officer*

NICHOLAS P. GODICI
*Acting Director of the United States Patent and Trademark Office*